US010696450B2

(12) United States Patent
Valentini et al.

(10) Patent No.: US 10,696,450 B2
(45) Date of Patent: Jun. 30, 2020

(54) ONE PIECE CONTAINER

(71) Applicant: VANGUARD PACKAGING, INC., Kansas City, MO (US)

(72) Inventors: David Anthony Valentini, Bentonville, AR (US); Jerry Ryan Frost, Kansas City, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 119 days.

(21) Appl. No.: 15/912,180

(22) Filed: Mar. 5, 2018

(65) Prior Publication Data

US 2018/0194515 A1 Jul. 12, 2018

Related U.S. Application Data

(60) Division of application No. 15/369,574, filed on Dec. 5, 2016, now Pat. No. 9,908,663, which is a (Continued)

(51) Int. Cl.
*B65D 19/04* (2006.01)
*B65D 19/20* (2006.01)
(Continued)

(52) U.S. Cl.
CPC ..... *B65D 19/38* (2013.01); *B31B 50/14* (2017.08); *B31B 50/25* (2017.08); *B31B 50/26* (2017.08);
(Continued)

(58) Field of Classification Search
CPC ..... B65D 19/385; B65D 19/04; B65D 19/20; B31B 50/14; B31B 50/26; B31F 1/0006
(Continued)

(56) References Cited

U.S. PATENT DOCUMENTS 2,578,060 A 12/1951 Grant
2,918,178 A 12/1959 Leone
(Continued)

FOREIGN PATENT DOCUMENTS

DE 3824930 A1 1/1990
GB 1188834 A 4/1970

OTHER PUBLICATIONS

"Non-Final office action received for U.S. Appl. No. 14/216,274 dated Jun. 17, 2016" 7 pages.
(Continued)

*Primary Examiner* — Gloria R Weeks
(74) *Attorney, Agent, or Firm* — Kutak Rock LLP

(57) ABSTRACT

A container comprising a first side-panel section separated from a second side-panel section. Each of the first and second side-panel sections includes a side portion fold line extending laterally across the side-panel sections, such that each side-panel section presents two side portions. Furthermore, the container includes a pair of end flaps extending along lateral edges of the first and second side-panel sections and separated from the side-panel sections via primary fold lines, with the end flaps operable to connect the first and second side-panel sections together. The container is configured to be erected from a knockdown configuration by folding together the first side-panel section and the second side-panel section, and extending the first side-panel section and the second side-panel section away from each other such that the container forms a rectangular perimeter.

8 Claims, 9 Drawing Sheets

Related U.S. Application Data continuation of application No. 14/216,274, filed on Mar. 17, 2014, now Pat. No. 9,511,899.

(60) Provisional application No. 61/793,340, filed on Mar. 15, 2013.

(51) Int. Cl.

| | |
|---|---|
| ***B65D 19/38*** | (2006.01) |
| ***B31F 1/00*** | (2006.01) |
| ***B65D 71/00*** | (2006.01) |
| ***B31B 50/14*** | (2017.01) |
| ***B31B 50/26*** | (2017.01) |
| ***B31B 50/25*** | (2017.01) |
| ***B31B 50/44*** | (2017.01) |

(52) U.S. Cl.

CPC ..... *B31B 50/44* (2017.08); *B31F 1/0006* (2013.01); *B31F 1/0032* (2013.01); *B31F 1/0051* (2013.01); *B65D 19/20* (2013.01); *B65D 19/385* (2013.01); *B65D 71/0096* (2013.01); *B65D 2519/00029* (2013.01); *B65D 2519/00159* (2013.01); *B65D 2519/00915* (2013.01); *B65D 2571/00037* (2013.01)

(58) Field of Classification Search

USPC ..... 229/165, 172, 236; 53/456; 493/56, 63, 493/162

See application file for complete search history.

(56) References Cited

U.S. PATENT DOCUMENTS

| | | | | |
|---|---|---|---|---|
| 3,195,798 | A | 7/1965 | Wilson | |
| 3,362,610 | A | 1/1968 | Dyke | |
| 3,987,737 | A | 10/1976 | Smith | |
| 4,341,338 | A | 7/1982 | Arnold | |
| 4,383,636 | A | 5/1983 | Chaffers | |
| 4,427,108 | A | 1/1984 | Coles et al. | |
| 4,458,838 | A | 7/1984 | Lacasa et al. | |
| 4,506,790 | A | 3/1985 | Muscari | |
| 4,567,996 | A | 2/1986 | Muise | |
| 4,646,922 | A | 3/1987 | Smith | |
| 4,871,067 | A | 10/1989 | Valenti | |
| 4,969,595 | A * | 11/1990 | Teasdale | B65D 5/422 206/459.5 |
| 5,016,545 | A | 5/1991 | Robertson et al. | |
| 5,145,244 | A | 9/1992 | Kersting et al. | |
| 5,190,211 | A | 3/1993 | Stoddard et al. | |
| 5,193,466 | A | 3/1993 | Eder | |
| 5,213,220 | A | 5/1993 | McBride | |
| 5,253,769 | A | 10/1993 | Vlastakis | |
| 5,277,360 | A | 1/1994 | Demott | |
| 5,301,800 | A | 4/1994 | Kenney | |
| 5,316,210 | A | 5/1994 | Scullin | |
| 5,333,777 | A | 8/1994 | Roth | |
| 5,702,011 | A | 12/1997 | Carroll | |
| 5,706,959 | A | 1/1998 | Smith | |
| RE35,875 | E * | 8/1998 | Shuert | 108/55.1 |
| 5,826,732 | A | 10/1998 | Ragsdale | |
| 5,966,857 | A | 10/1999 | Pettersson et al. | |
| 6,068,140 | A | 5/2000 | Mangrum et al. | |
| 6,126,254 | A | 10/2000 | Maglione | |
| 6,347,772 | B1 | 2/2002 | L'Hotel | |
| 6,378,710 | B1 | 4/2002 | Grueneberg | |
| 6,440,050 | B1 * | 8/2002 | Capparelli | B65D 5/0005 229/101.2 |
| 6,508,023 | B2 | 1/2003 | Moss et al. | |
| 6,581,772 | B2 | 6/2003 | Noland | |
| 6,612,669 | B2 | 9/2003 | Grueneberg | |
| 6,715,623 | B2 | 4/2004 | Broerman | |
| 7,007,615 | B2 | 3/2006 | Grueneberg | |
| 7,066,342 | B2 | 6/2006 | Baechle et al. | |
| 7,111,735 | B2 | 9/2006 | Lowry | |
| 7,137,517 | B2 | 11/2006 | Lowry et al. | |
| 7,252,200 | B1 | 8/2007 | Hester | |
| 7,281,648 | B2 | 10/2007 | Lowry | |
| 7,284,662 | B2 | 10/2007 | Debusk et al. | |
| 7,546,927 | B2 | 6/2009 | Lowry et al. | |
| 7,634,865 | B2 | 12/2009 | L'Hôtel | |
| 7,681,735 | B2 * | 3/2010 | Youell, Jr. | B65D 19/20 108/51.3 |
| 7,708,187 | B2 | 5/2010 | Keefe et al. | |
| 8,596,518 | B2 | 12/2013 | Babcock | |
| 8,763,888 | B2 | 7/2014 | Willman et al. | |
| 9,126,721 | B2 | 9/2015 | Dye et al. | |
| 9,511,899 | B1 | 12/2016 | Valentini et al. | |
| 9,908,663 | B1 | 3/2018 | Valentini et al. | |
| 10,329,046 | B2 * | 6/2019 | Smith | B65D 5/3628 |
| 10,513,368 | B2 * | 12/2019 | Iwahara | B65D 19/20 |
| 2002/0108541 | A1 | 8/2002 | Grueneberg | |
| 2003/0160015 | A1 | 8/2003 | Broerman | |
| 2004/0118742 | A1 | 6/2004 | Shuert | |
| 2005/0067321 | A1 | 3/2005 | Pitts et al. | |
| 2008/0030113 | A1 | 2/2008 | Vail | |
| 2008/0083682 | A1 | 4/2008 | Moss et al. | |
| 2008/0169340 | A1 | 7/2008 | Sheffer | |
| 2010/0006629 | A1 * | 1/2010 | Bettinger | B65D 5/029 229/109 |
| 2010/0108748 | A1 * | 5/2010 | Fleming | B65D 71/30 229/117.13 |
| 2010/0236117 | A1 | 9/2010 | Mestres et al. | |
| 2012/0012734 | A1 | 1/2012 | Tzuo | |
| 2012/0267284 | A1 * | 10/2012 | Thimmesch | B65D 71/0096 206/597 |
| 2013/0213915 | A1 | 8/2013 | Pfeifer et al. | |
| 2013/0284799 | A1 * | 10/2013 | Hallam | B65D 5/0254 229/126 |
| 2014/0061288 | A1 * | 3/2014 | Dashe | G09F 1/06 229/100 |
| 2016/0075465 | A1 * | 3/2016 | Wiley | B65D 81/26 206/459.5 |
| 2016/0144994 | A1 * | 5/2016 | Flaming | B65D 5/0015 206/509 |
| 2017/0217633 | A1 * | 8/2017 | Lundius | B65D 19/06 |
| 2018/0127148 | A1 * | 5/2018 | Kuhn | B62B 3/002 |
| 2018/0229917 | A1 * | 8/2018 | Jobe | B65D 65/466 |
| 2019/0112095 | A1 * | 4/2019 | Swarnaraj | B65D 5/005 |

OTHER PUBLICATIONS

"Notice of Allowance received for U.S. Appl. No. 15/369,574, dated Oct. 24, 2017." 7 pages.

"Notice of Allowance received for U.S. Appl. No. 14/216,274 dated Oct. 24, 2016" 7 pages.

* cited by examiner

ONE PIECE CONTAINER

RELATED APPLICATIONS

This application is a divisional application of co-pending U.S. patent application Ser. No. 15/369,574 filed Dec. 5, 2016, which is a continuation of U.S. patent application Ser. No. 14/216,274, filed Mar. 17, 2014, (now U.S. Pat. No. 9,511,899), which claims priority pursuant to 35 U.S.C. 119(e) to U.S. Provisional Patent Application Ser. No. 61/793,340, filed Mar. 15, 2013, the entire disclosures of which are incorporated herein by reference.

FIELD

Embodiments of the present invention relate generally to the field of point of purchase merchandise shipping and display containers. More particularly, embodiments of the present invention relate to a corrugated, paperboard container that is manufactured in a fold and glue assembly process and that is traditionally provided to an end user in a collapsed or knockdown configuration for setup.

BACKGROUND

Corrugated containers are often made from pieces of flat paperboard stock material that are die cut into shapes that define various panels. The shapes are folded along predefined lines between the panels with at least one overlapping strip or panel that is glued, taped or otherwise affixed to another panel to form an enclosed boundary. The panels are folded and/or glued into place to become the walls of the container. The containers are traditionally provided to product manufacturers and/or retailers in a collapsed or knockdown configuration for storage, handling, and shipping. The manufacturer and/or retailers open the knockdown containers and fold appropriately to utilize the assembled container for packing and/or displaying items positioned therein.

The knockdown containers are typically manufactured by feeding flat die cut sheets through a fold-and-glue machine. The fold-and-glue machine applies adhesive and folds over select panels so that the panels are in the knock-down configuration. One common knockdown container is a pallet container, such as a pallet skirt, that is utilized for encompassing a wooden pallet or stack of wooden pallets to conceal and/or improve aesthetics of items displayed on the pallet(s) in a retail environment. Conventional containers are made from multiple pieces of corrugated material that are attached together by gluing or otherwise securing the pieces together. This adds to the manufacturing and/or assembly complexity, time and costs associated with such items. Therefore, it would be beneficial to provide a container that is made from a single piece of material and/or that does not require the use of glue or other adhesives during manufacturing or assembly.

SUMMARY

Embodiments of the present invention include a pallet skirt comprising a first side-panel section separated from a second side-panel section via a perforated segment extending down a longitudinal centerline of the pallet skirt when in a knockdown configuration. Additionally, each of the first and second side-panel sections includes a side portion fold line extending laterally across the side-panel sections, such that each side-panel section presents two side portions. Furthermore, the pallet skirt includes a pair of end flaps extending along lateral edges of the first and second side-panel sections and separated from the side-panel sections via primary fold lines, with the end flaps being operable to connect the first and second side-panel sections together.

Embodiments of the present invention additionally include a method for making a corrugated pallet skirt comprising: forming a first side-panel section separated from a second side-panel section via a perforated segment that extends down a longitudinal centerline of the pallet skirt when in a knockdown configuration; forming a side portion fold line laterally across each of the first and second side-panel sections, such that each side-panel section presents two side portions; forming end flaps that extend along lateral edges of the first and second side-panel sections; and forming primary fold lines between the end flaps and the side-panel sections.

Embodiments of the present invention additionally include a method of erecting a pallet skirt comprising the steps of providing the pallet skirt in a knockdown configuration, with the pallet skirt including a first side-panel section separated, a second side-panel section, and end flaps that extend along lateral edges of the first and second side-panel sections. The next step includes folding together the first side-panel section and the second side-panel section about a perforated segment. Finally, the method includes the step of extending the first side-panel section and the second side-panel section away from each other such that the pallet skirt forms a rectangular perimeter including four sides.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWING FIGURES

Embodiments of the present invention are described in detail below with reference to the attached drawing figures, wherein.

Figure 1:
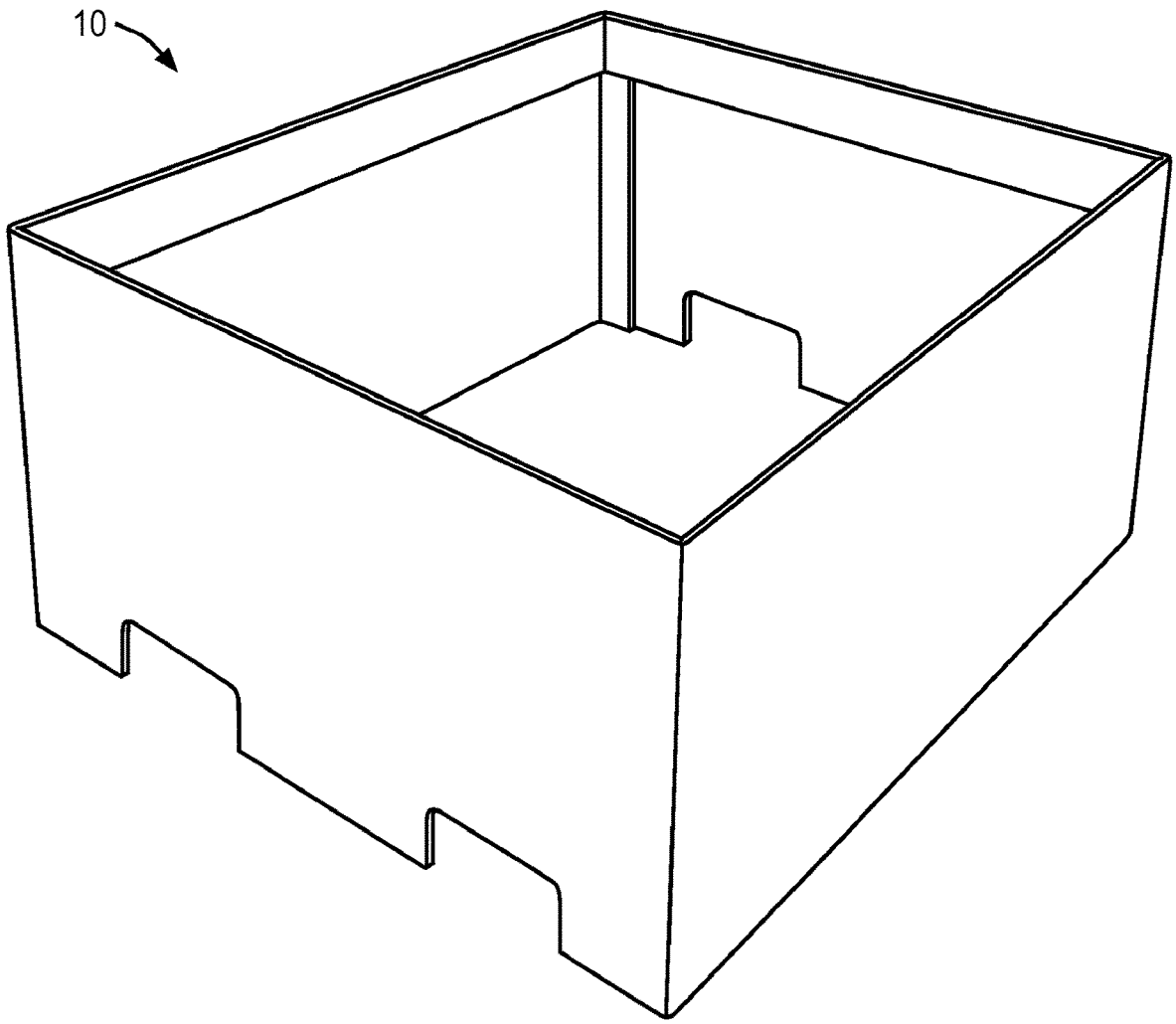
FIG. 1 is a perspective view of a pallet skirt in an erected configuration according to embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As used herein, the term "longitudinal" generally refers to an orientation or direction relative to an axis of elongation, whereas lateral refers to an orientation or direction that is generally perpendicular to the axis of elongation.

Figure 2:
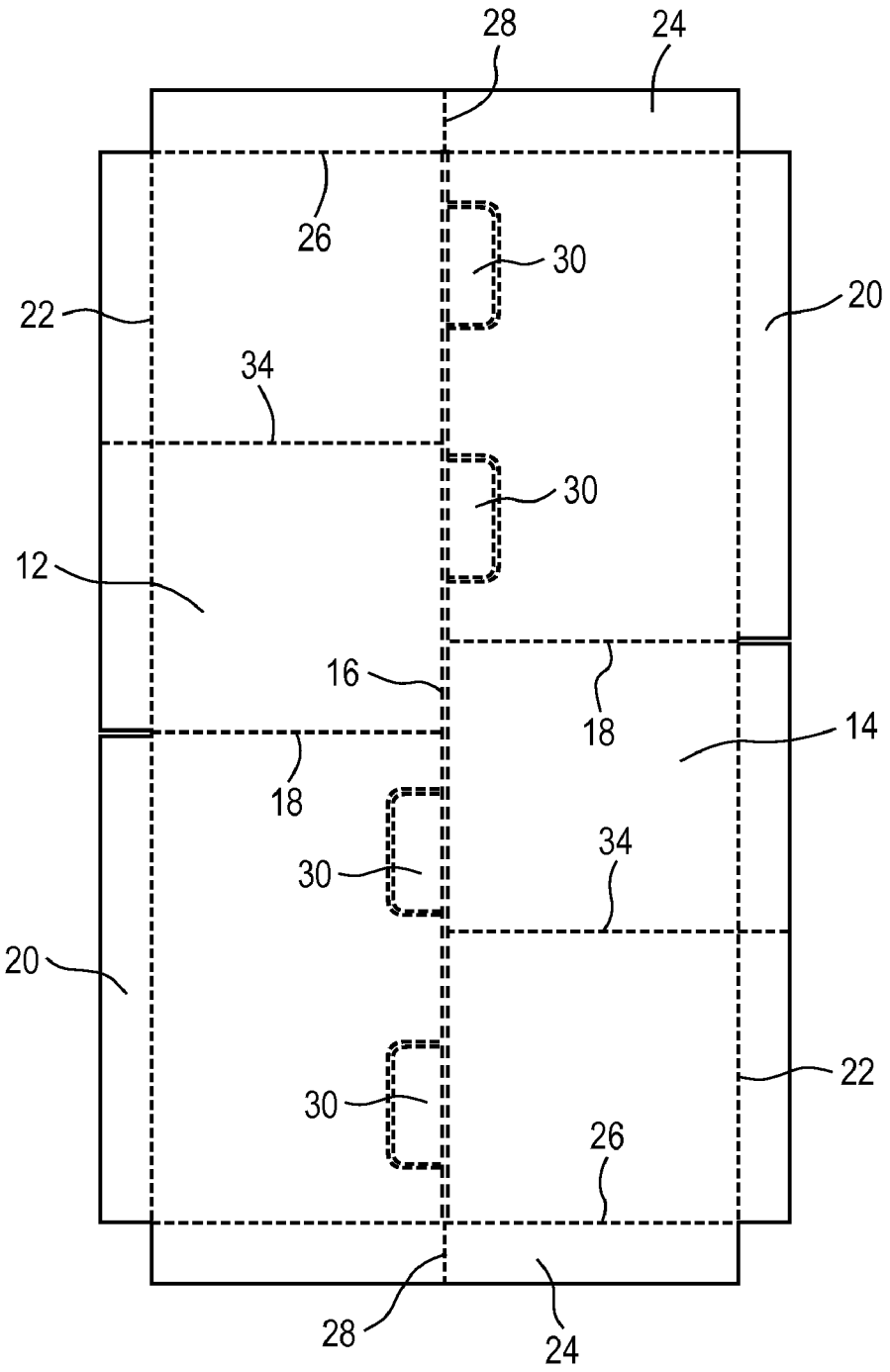
FIG. 2 is a plan view the pallet skirt from FIG. 1 in a knockdown configuration.

As shown in FIG. 1, embodiments of the present invention include a pallet skirt 10 that is formed from a single, rectangular-shaped piece of corrugated material. In certain embodiments, such corrugated material includes paperboard. Nevertheless, other embodiments provide for the corrugated material to include other similar types of materials, such as cardboard, fiberboard, or the like. The pallet skirt 10 of embodiments of the present invention is capable of being initially provided in a knockdown configuration, such as illustrated in FIG. 2. In such embodiments, the pallet skirt 10 as illustrated has a generally rectangular shape. The pallet skirt 10 includes a first side-panel section 12 and a second side-panel section 14 separated by a perforation/cut line 16 (shown via a pair of parallel dashed lines in FIG. 2) that extends down a longitudinal centerline of the rectangular-shaped piece of corrugated material. As shown in FIG. 2, perforation line 16, does not extend all the way to the opposing ends, 24, of pallet skirt 10, such that side-panel sections 12 and 14 remain connected along each ends 24. In certain embodiments, the perforation line 16 is formed on the pallet skirt 10 by die-cut or other method of creating a perforation. As will be discussed in more detail below, the pallet skirt 10 in its erected configuration generally comprises four sides. Thus, each of the side-panel sections 12, 14 includes two side portions that each present one of the sides when the pallet skirt is in its erected configuration. As illustrated in FIG. 1 and FIG. 2, the two side portions for each of the side-panel sections 12, 14 are separated from one another by side portion fold lines 18. In certain embodiments, such side portion fold lines 18 are created by compressing along a thin fine of the corrugated material to define the fold lines. In other embodiments, the fold lines 18 are formed by cutting part way through along the fold line, or in additional embodiments, by cutting all or part way through the fold line at spaced intervals. As such, each of the side portions on a side-panel section 12, 14 are capable of being easily rotated or folded with respect to each other. In certain embodiments, the pallet skirt 10 in an erected configuration is generally square-shaped, such that each of the side portions are generally equivalent in size and the side section fold lines 18 laterally bisect each of the side-panel sections 12, 14. In other embodiments, however, the pallet skirt 10 in an erected configuration has a rectangular shape. In such embodiments, the side portions are not equivalent in size and the side section fold lines 18 are positioned offset from the side-panel sections 12, 14 bisecting lateral axes. The different sizes and shapes of the pallet skirt 10 provide for the pallet skirt to be implemented with pallets of various sizes and shapes.

Additionally, in certain embodiments, each of the first and second side-panel sections 12, 14 have an edge section 20 that extends along longitudinal edges of the pallet skirt 10 (i.e., along long sides of the rectangular-shaped pallet skirt). The edge sections 20 are separated from the side-panel sections 12, 14 by edge section fold lines 22. In certain embodiments, such edge section fold lines 22 are created by compressing along a thin line of the corrugated material to define the fold lines. In other embodiments the fold lines are formed by cutting part way through along the fold line, or alternatively, by cutting all the way or part way through the fold line at spaced intervals. As such, each of the edge sections 20 on a given side-panel section are capable of being rotated or folded easily with respect to their respective side-panel section 12, 14.

In certain embodiments, the first and second side-panel sections 12, 14 are connected together by a pair of opposing end flaps 24. The end flaps 24 are positioned in some embodiments along lateral edges of the pallet skirt 10 (i.e., along short sides of the rectangular-shaped pallet skirt). The end flaps 24 are connected to the first and second side-panel sections 12, 14 via primary fold lines 26. In certain embodiments, such primary fold lines 26 are created by compressing along a thin line of the corrugated material to define the fold line. In other embodiments, the fold lines are formed by cutting part way through along the fold line, or alternatively, by cutting all the way or part way through the fold line at spaced intervals. As such, each of the end flaps 24 are capable of being rotated or folded easily with respect to the first and second side-panel sections 12, 14, or visa-a-versa. In additional embodiments, the end flaps 24 each include a secondary fold line 28 that separate portions of the end flap that connect to each of the first and second side-panel sections 12,14. In certain embodiments, the secondary fold lines 28 are generally aligned or collinear with the perforated segment 16. Such secondary fold lines 28 are created in some embodiments by compressing along a thin line of the corrugated material to define the fold lines. In other embodiments, the fold lines are formed by cutting part way through along the fold line, or alternatively, by cutting all the way through or part way through the fold line at spaced intervals. As such, each of the end flaps 24 is capable of being rotated or folded easily with respect to each other. Thus, the side-panel sections 12, 14 are held together by the end flaps 24 on the lateral sides of the pallet skirt 10, and the end flaps 24 secure the side-panel sections 12, 14 together in both a knockdown configuration and an erected configuration (i.e., when assembled), as will be discussed in more detail below.

In certain embodiments, the pallet skirt 10 additionally includes two or more cutouts 30 formed through portions of the first and/or second side-panel sections 12, 14. The cutouts 30 are shaped in some embodiments in the form of a rectangle, or in other embodiments, are formed in other shapes, such a circular, oblong, square, triangular, or the like. As will be discussed in more detail below, the cutouts 30 provide for fork members of a forklift tractor to be inserted therethrough, such that the forklift tractor can lift the pallet skirt 10 and its associated pallet without requiring the pallet skirt to be removed from the pallet or otherwise reconfigured in any way.

Figure 3:
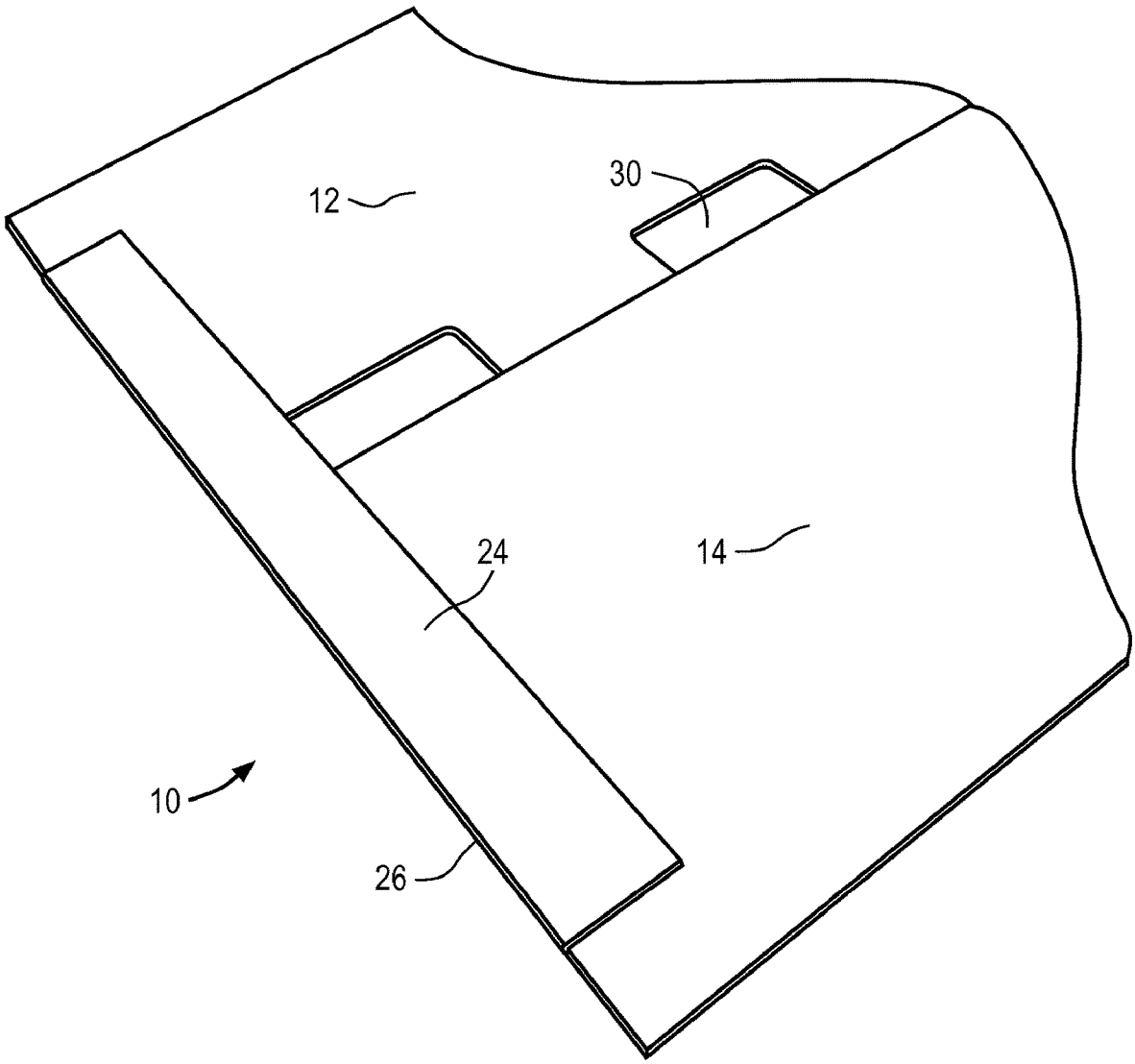
FIG. 3 is a partial view of the pallet skirt from FIGS. 1-2, with the partial view illustrating an end flap being folded over first and second side-panel sections.
Figure 4:
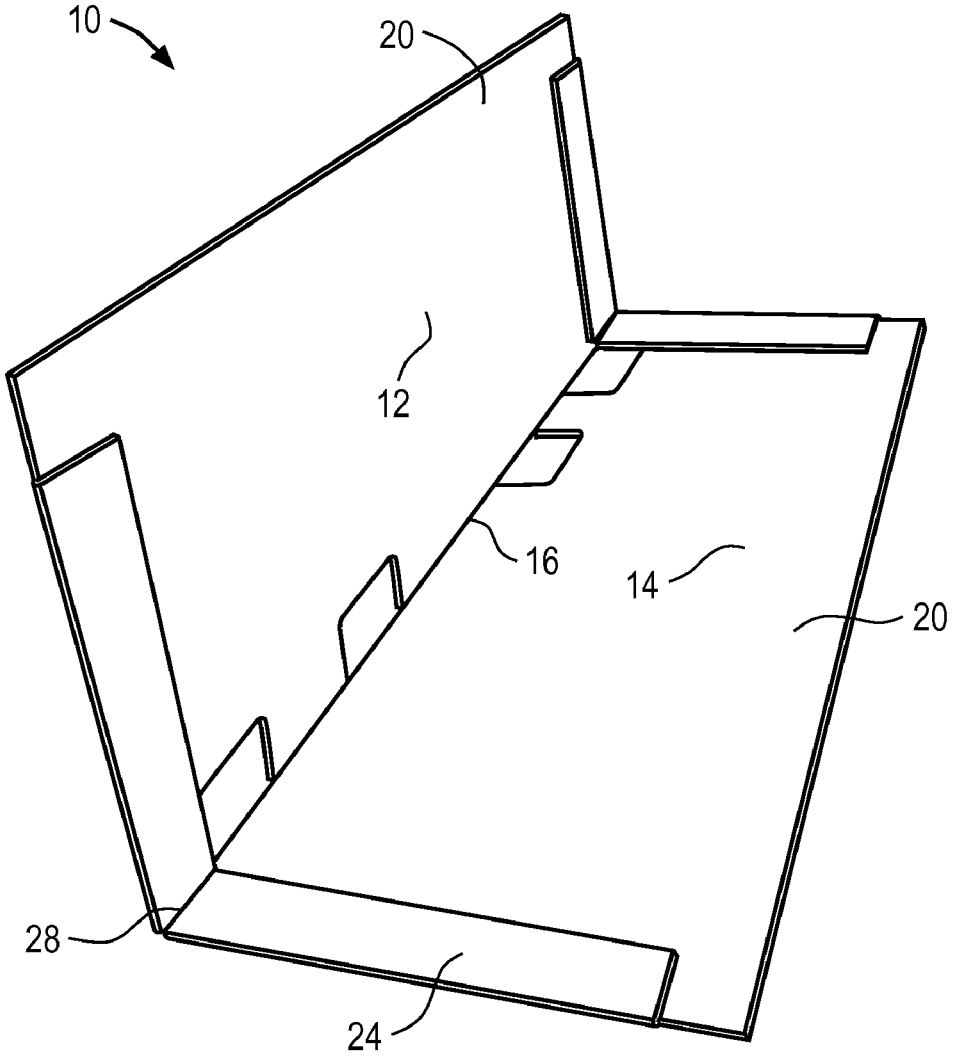
FIG. 4 is a perspective view of the pallet skirt from FIGS. 1-3, with the first side-panel section being folded over the second side-panel section.
Figure 5:
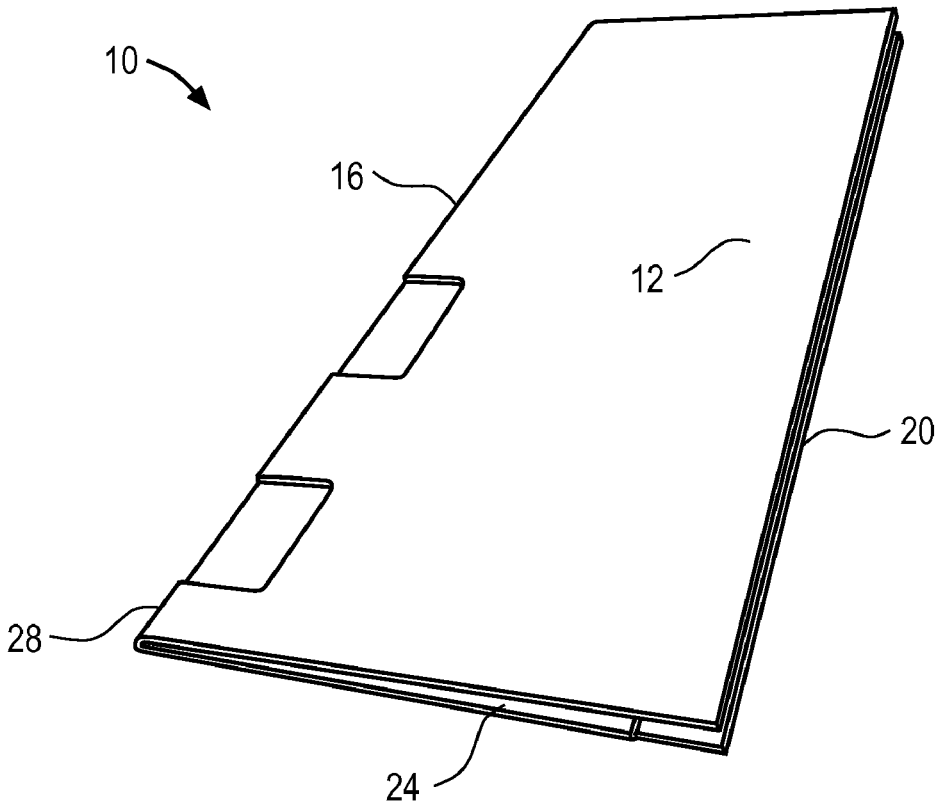
FIG. 5 is a perspective view of the pallet skirt from FIGS. 1-4, with the first side-panel section folded over the second side-panel section.

The pallet skirt 10 is capable of being initially provided in the knockdown configuration (i.e., a generally flat, two-dimensional form), such as illustrated in FIG. 2. From the knockdown configuration, the pallet skirt 10 is capable of being assembled and/or transformed into the erected configuration, such as shown in FIG. 1. In operation, the pallet skirt 10 is assembled by initially folding each of the end flaps 24 about the primary fold lines 26 over the first and second side-panel sections 12, 14, such as illustrated in FIG. 3. Next, as illustrated by FIGS. 4-5, the side-panel sections 12, 14 and the end flaps 24 are then folded about the perforated segment 16 and the secondary fold lines 28 (i.e. about the longitudinal axis of the pallet skirt 10) until the edge sections 20 of each the first and second side-panel sections are adjacent with each other and generally parallel. Thereafter, as illustrated by FIG. 6, the side-panel sections 12, 14 are pulled apart from each other (with section 12 and 14 being completely separated along perforated segment 16), forming a box (square or rectangular, depending upon the dimensions of the side portions of the side-panel sections 12,14), with the side-panel sections being connected to each other by the end flaps 24.

Figure 6:
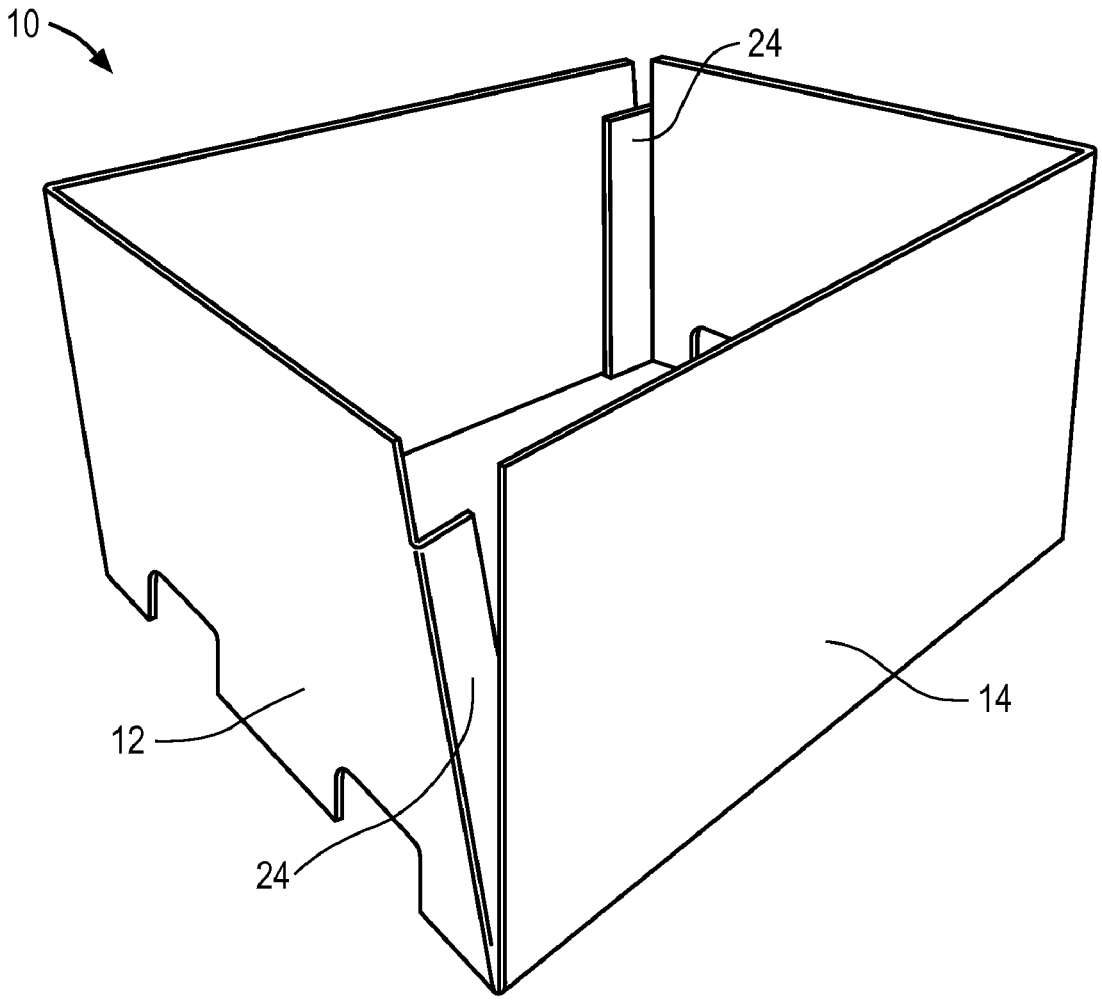
FIG. 6 is a perspective view of the pallet skirt from FIGS. 1-5, with the first side-panel section being separated from the second side-panel section to form the erected configuration.
Figure 7:
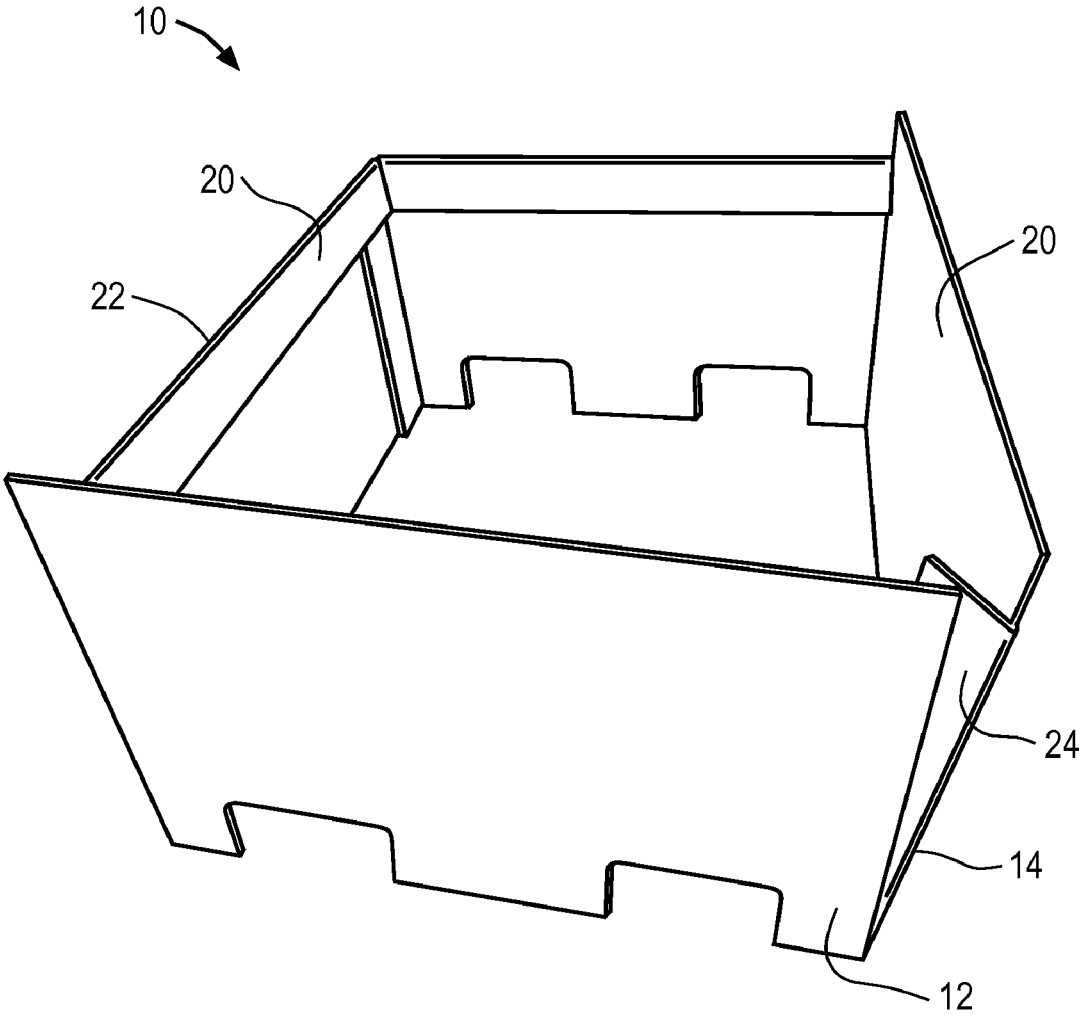
FIG. 7 is a perspective overhead view of the pallet skirt from FIGS. 1-6, with the first side-panel section separated from the second side-panel section to form the erected configuration.

With the pallet skirt 10 in such a configuration, surfaces of each of the end flaps 24 that are adjacent each other and secured together (at the bottom as seen in FIG. 6) by being folded about the secondary fold line 28. In some embodiments, these surfaces are secured together by glue or other adhesives. Nevertheless, in other embodiments, such as illustrated by FIG. 7, the edge sections 20 are folded about the edge section fold lines 22 until they are adjacent with their corresponding side-panel section 12, 14. As such, the edge sections 20 secure the adjacent surfaces of the end flaps 24 together and against a side-panel section 12, 14 without requiring glue or other adhesive. In some embodiments, glue or other adhesive are used for additional bonding.

Figure 8:
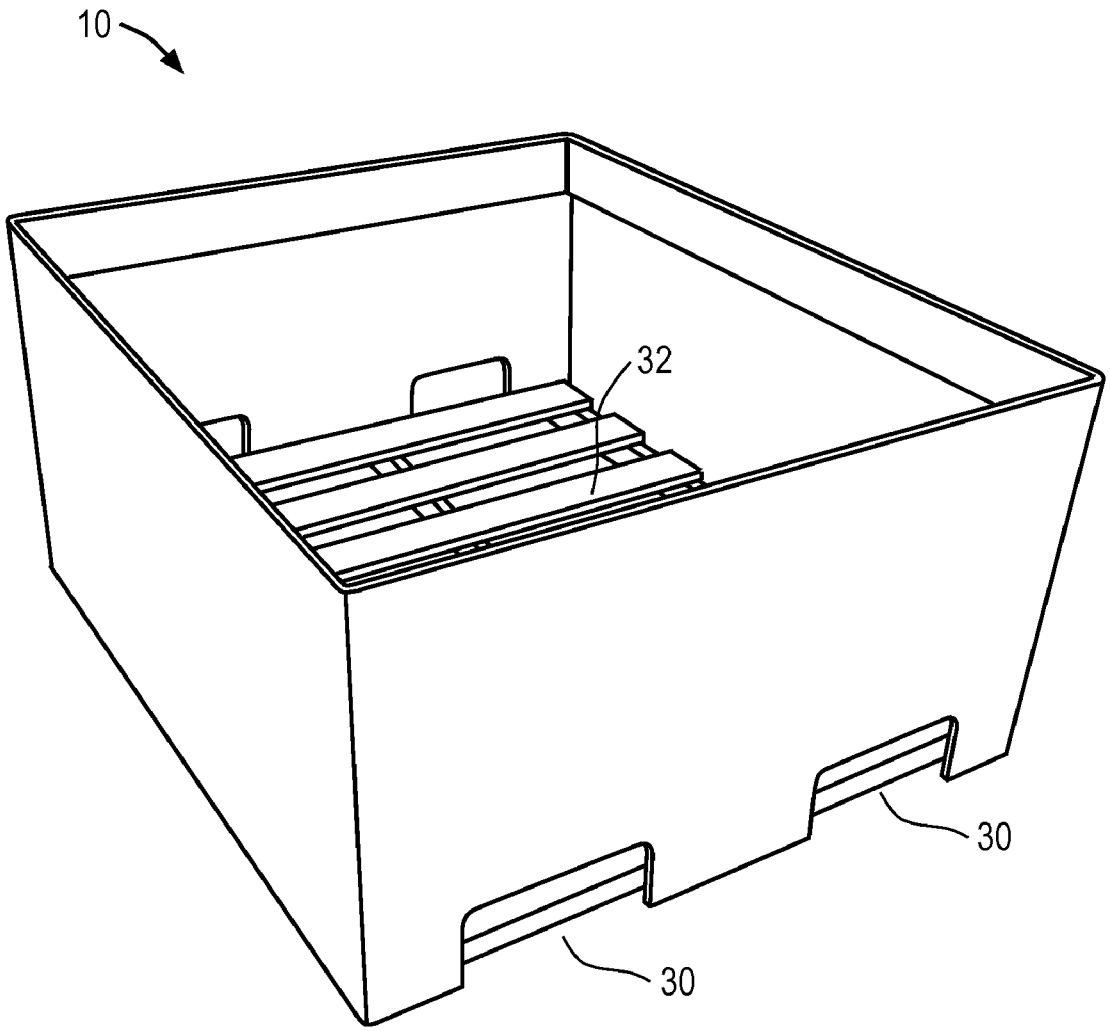
FIG. 8 is a perspective view of the pallet skirt from FIGS. 1-7 in an erected configuration and positioned over a pallet.

As Illustrated by FIG. 8, the pallet skirt 10 is secured in the erected configuration and is capable of being positioned over a pallet 32 for securing items therein. For instance, with the pallet skirt 10 positioned over the pallet 32, items are capable of being positioned on the pallet and secured thereon by the sides portions of the side-panel sections 12, 14 of the pallet skirt. Alternatively, the pallet skirt 10 is positioned over pallet 32 after items have been positioned and secured on the pallet 32. As previously described, certain embodiments of the present invention include cutouts 30 positioned along portions of the pallet skirt 10 to allow forks of a forklift tractor to be inserted through the pallet 32 and the pallet skirt to lift the pallet without requiring removal of the pallet skirt from the pallet. In some embodiments, the cutouts 30 are formed via perforation lines, such that material comprising the cutouts 30 are detachably secured to the pallet skirt 10 and are capable of being selectively removed by an end user if desired. In alternative embodiments, the material comprising the cutouts 30 may be left attached if not needed and to allow for improved aesthetics.

Figure 9:
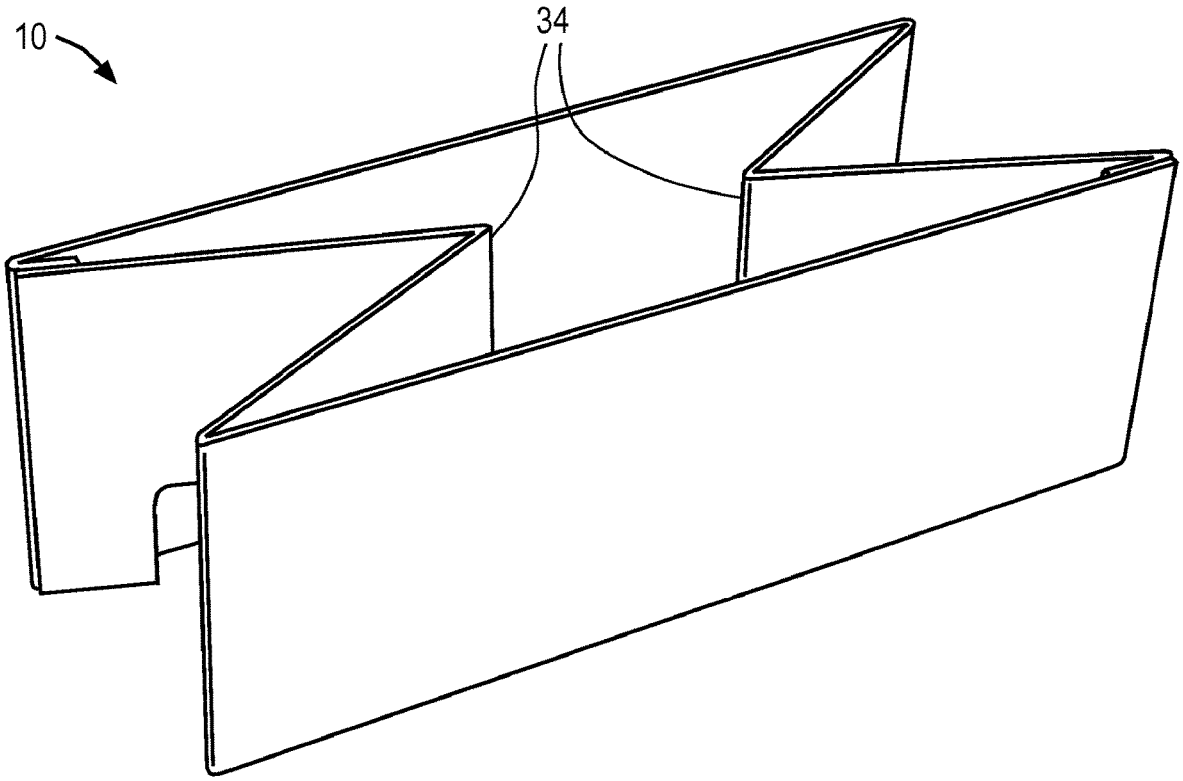
FIG. 9 is a perspective view of a pallet skirt according to embodiments of the present invention, with the pallet skirt being folded by supplemental side portion fold lines.

Although the invention has been described with reference to the embodiments illustrated in the attached drawing figures, it is noted that equivalents may be employed and substitutions made herein without departing from the scope of the invention as recited in the claims. For instance, in certain embodiments, the pallet side-panel sections 12, 14 of the pallet skirt 10 include supplemental side portion fold lines 34 in addition to the side portion lines 18. As illustrated by FIG. 2, such supplemental side portion fold lines 34 are positioned generally parallel with the side-panel fold lines 18, such that one or more of the side portions of the side-panel sections 12, 14 are capable of being folded about the supplemental fold lines. The supplemental side portion fold lines 34 allow for the pallet skirt 10 in its erected configurations to be quickly folded together in a flat, two-dimensional configuration for easy storage and/or transport. For example, as illustrated by FIG. 9, after removing the pallet skirt 10 from a pallet, the side portions with the supplemental side portion fold lines 34 formed thereon are folded about the supplemental fold lines 34 such that the pallet skirt forms an "x" or an accordion shape. Consequently, the pallet skirt 10 is compressed into a flat, generally two-dimensional configuration that facilitates storage and shipping. Furthermore, in certain embodiments, such folding is performed at a manufacturing location, and the flat, two-dimensional pallet skirt 10 may be transport and unfolded at a later time for use.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

The invention claimed is:

1. A method of making a container, comprising:

forming a first side-panel section separated from a second side-panel section via a perforated segment that extends down a longitudinal centerline of said container;

forming a side portion fold line laterally across each of said first and second side-panel sections, such that each side-panel section presents two side portions;

forming a first end flap that extends along a first lateral edge of said first and second side-panel sections;

forming a primary fold line between said end flaps and said side-panel sections; and forming a secondary fold line on said first end flap at a position that is aligned with said longitudinal centerline of the container, such that said first and second side panel sections can be folded together about said perforated segment and said secondary fold line.

2. The method of claim 1, wherein said container is formed from corrugated paperboard material.

3. The method claim 1, further including the step of:

forming edge sections that extend along a first longitudinal edge of each of said first and second side-panel sections; and forming edge section fold lines that separate said edge sections from said side-panel sections.

4. The method of claim 3, wherein each edge section comprises:

a proximal edge hingedly secured to said first edge of said side panel section;

a distal edge opposed to said proximal edge; and side edges extending between said proximal and distal edges, wherein said distal edge is narrower than said proximal edge such that at least one side edge of a first edge section is angled so as to correspond with an angled side edge of a second edge section.

5. The method of claim 1, further including forming a second end flap that extends along a second lateral edge of said first and second side panel sections and forming a secondary fold line on said second end flap at a position that is aligned with said longitudinal centerline of said container, such that said first and second side-panel sections can be folded together about said perforated segment and said secondary fold line.

6. The method claim 5, wherein in addition to said side-panel sections being operable to be folded together, said side-panel sections are operable to be separated away from each other and folded about said side portion fold lines such that said container forms a rectangular perimeter including four sides.

7. The method claim 1, wherein said first and second side-panel sections each include an additional fold line extending laterally across said side-panel section and parallel with said side portion fold line.

8. The method of claim 1, wherein the container is a pallet skirt container having a perimeter that corresponds with a perimeter of a pallet such that the pallet skirt container is operable to fit around the perimeter of the pallet.

* * * * *